US005452985A

United States Patent [19]

Roch et al.

[11] Patent Number: 5,452,985

[45] Date of Patent: Sep. 26, 1995

[54] ARTICLE HANDLING SYSTEM, ESPECIALLY FOR AN AUTOMATIC MAIL SORTING MACHINE

[75] Inventors: Olivier Roch, Valence; Daniel Abraham, Bourg Les Valence; Laurent Pellegrin, Livron; Frédéric Mestrallet, Etoile, all of France

[73] Assignee: Compagnie Generale d'Automatisme CGA-HBS, Bretigny sur Orge, France

[21] Appl. No.: 24,748

[22] Filed: Mar. 2, 1993

[30] Foreign Application Priority Data

Mar. 3, 1992 [FR] France ..... 92 02513

[51] Int. Cl.[6] ..... B65B 67/00

[52] U.S. Cl. ..... 414/798.2; 414/924; 414/907; 53/390

[58] Field of Search ..... 53/244, 542, 390; 414/923, 924, 930, 900, 907, 798.2

[56] References Cited

U.S. PATENT DOCUMENTS

| | | | |
|---|---|---|---|
| 2,919,528 | 1/1960 | White | 53/390 |
| 3,097,460 | 7/1963 | O'Brien | 53/244 |
| 3,865,365 | 2/1975 | Hardin et al. . | |
| 3,866,392 | 2/1975 | Weeks et al. | 53/390 |
| 4,518,160 | 5/1985 | Lambrechts et al. | 53/542 |
| 4,522,016 | 1/1985 | DiRico | 53/390 |
| 4,768,328 | 6/1988 | Mims | 53/542 |
| 5,233,814 | 8/1993 | Bergerioux et al. | 53/542 |

*Primary Examiner*—Michael S. Huppert
*Assistant Examiner*—Gregory A. Morse
*Attorney, Agent, or Firm*—Sughrue, Mion, Zinn, Macpeak & Seas

[57] ABSTRACT

An article handling system including a frame defining an upper, horizontal working surface (20). The system further includes a device (24) for supporting a receptacle (22) for final reception of articles, an elongated plate (10) mounted for pivotal movement about a pivot device (72, 74), and a device (26) for retaining the articles. The device for retaining the articles includes an elongated support (28) disposed parallel to the length of the plate in its horizontal position and fixed to remain immovable relative to the upper working surface at least in the vertical direction. The device for retaining the articles further includes a first member (30) for retaining the articles and fixed to a first end of the support and a second member (32) for retaining the articles mounted for movement relative to the support and guided by the support, a restoring device (40) urging the second retaining member toward the first retaining member, and a device (42) for positioning the articles fixed to the support and disposed parallel to the plate.

7 Claims, 6 Drawing Sheets

ARTICLE HANDLING SYSTEM, ESPECIALLY FOR AN AUTOMATIC MAIL SORTING MACHINE

BACKGROUND OF THE INVENTION

1. Field of the Invention

The present invention relates to an article handling system, especially for an automatic mail sorting machine.

An automatic mail sorting machine generally comprises the following parts:

- a supply magazine in which the operator places the mail to be handled, the mail then being taken charge of to be presented to a stacker;
- a de-stacker whose function is to separate the letters or similar articles from one another, so as to feed these one by one on to a conveyor system;
- a read head associated with a microprocessor and facing the conveyor system so as to identify each letter or piece of mail and to assign it to a storage area corresponding to its final destination, these storage areas pertaining to boxes and/or stackers;
- a series of boxes or stackers whose number varies depending the machines which are the recipients of the previously sorted letters, each box or stacker representing a predetermined sort destination.

The present invention more particularly concerns the implementation of a stacker preferably associated with complementary means facilitating the stacker manipulation.

2. Description of the Prior Art

The spread of automatic mail handling has involved the installation of sorting machines at small sorting centers, which are called route sorting centers as well as distribution sorting centers, the distribution sort being the last to be effected before the distribution to the users of the mail. Problems have been encountered in the size of the sorting machines and their space requirements, which has led to efforts to optimize the number of sorting destinations and, in consequence the number of stackers or boxes of the machine. It had been found that a route sort or a distribution sort can be effected by a machine with fewer sorting receptacles than hitherto, provided the number of sorting passes is increased.

The benefit of the machines is then dependent on very good management of usage involving reduction in dead time, avoidance of non-useful handling of mail, reduction in the number of operators, etc. The greatest gain in productivity is to be obtained in the operation of distribution sorting, i.e. during the preparation of the postman's walk. Preparation of the postman's walk implies sorting and ordering the mail in accordance with an order to be strictly observed. The ordering of the mail should correspond to the route actually followed by the postman. Depending on the number of letters to be sorted, the selected method of sorting, the number of destinations previously referred to there is the added factor of ensuring the quality of sorting the mail, implying strict respect for the ordering of the letters during the sorting procedures.

Implementation of these sorting techniques can be effected successfully if the following conditions are observed: keeping place during the presentation of the mail to the interior of each stacker; no mixing of stackers in between the various sorting passes, i.e. at the time of handling the articles of each stacker, both in the supply magazine of the sorting machine and also in the definitive addressing area at the end of the sort.

In other words, the article handling system for implementing the sorting procedures defined above should make it possible to ensure to the full the functions of stacking, of manual transfer from one stacker to another without changing the order of the articles and in an easy manner, and of emptying the stacker into the final receiving box for the mail.

SUMMARY OF THE INVENTION

One object of the invention is to provide an article handling system enabling the aforesaid functions to be ensured in the conditions at small sorting centers, i.e. with reduced available space, implying small space requirements of the sorting machines and the employment of only one operator.

In order to meet this object, the article handling system comprising a frame defining an upper, horizontal working surface is characterized in that it further comprises means for supporting a receptacle for final reception of articles, disposed below an opening formed in said upper surface, an elongated plate mounted for pivotal movement about an axis fixed to remain horizontal and perpendicular to the length of said plate, said plate having a first, horizontal position in which it closes said opening and being adapted to be put into a second pivoted position in which one of its ends reaches into said receptacle and means for retaining said articles, comprising elongated support means disposed parallel to the length of said plate in its horizontal position and fixed to remain immovable relative to said upper working surface at least in the vertical direction, a first retaining member for said articles fixed to a first end of said support means and a second retaining member for said articles mounted for movement relative to said support means and guided thereby, restoring means tending to approach said second retaining member to said first retaining member, and means for positioning said articles fixed to said support means and disposed parallel to said plate, whereby, when said plate is in its horizontal position, said articles can be stacked between said first and second retaining members, resting on said plate and being butted up against said positioning means and, when said plate is put in its pivoted position, said articles can be placed in said receptacle.

It will be understood that the system effectively meets the conditions previously set out. The assembly formed by the plate and the retaining means form the slacker in which the articles can be held in a very precise order, which implements the stacking function. Furthermore it is possible to extract the set of articles from the slacker to place them on another part of the horizontal working table, which implements the transfer function. Finally, by virtue of the possibility of pivoting the plate, it is possible to empty out the slacker directly into the receptacle or final receiving box for the sorted articles at the end of the various sorting operations, while maintaining their order.

In a preferred embodiment, the means for retaining articles are horizontally movable in translation relative to the said frame in the length direction of the plate. This latter feature facilitates the transfer operation, i.e. manually grasping the various articles placed in the stacker, because it allows the operator to bring the retaining means closer to him and thus to facilitate grasping the set of articles.

BRIEF DESCRIPTION OF THE DRAWINGS

Other features and advantages of the present invention will be seen better from a reading of the description which follows of a preferred embodiment of the invention, given by way of non-limiting example. The description refers to the accompanying drawings, in which.

DESCRIPTION OF THE PREFERRED EMBODIMENTS

Figure 1:
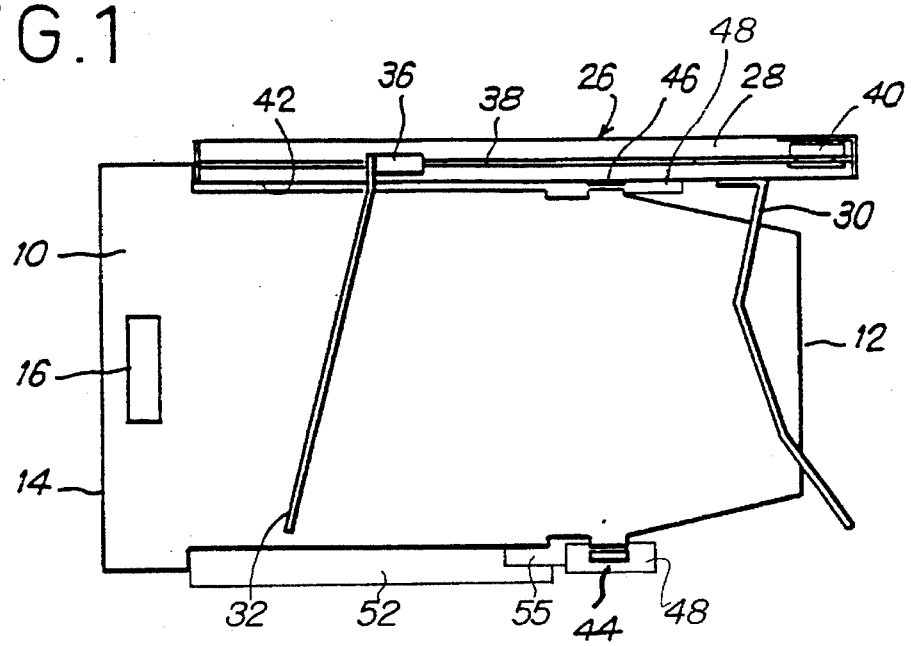
FIG. 1 is simplified top view of the stacker.
Figure 2:
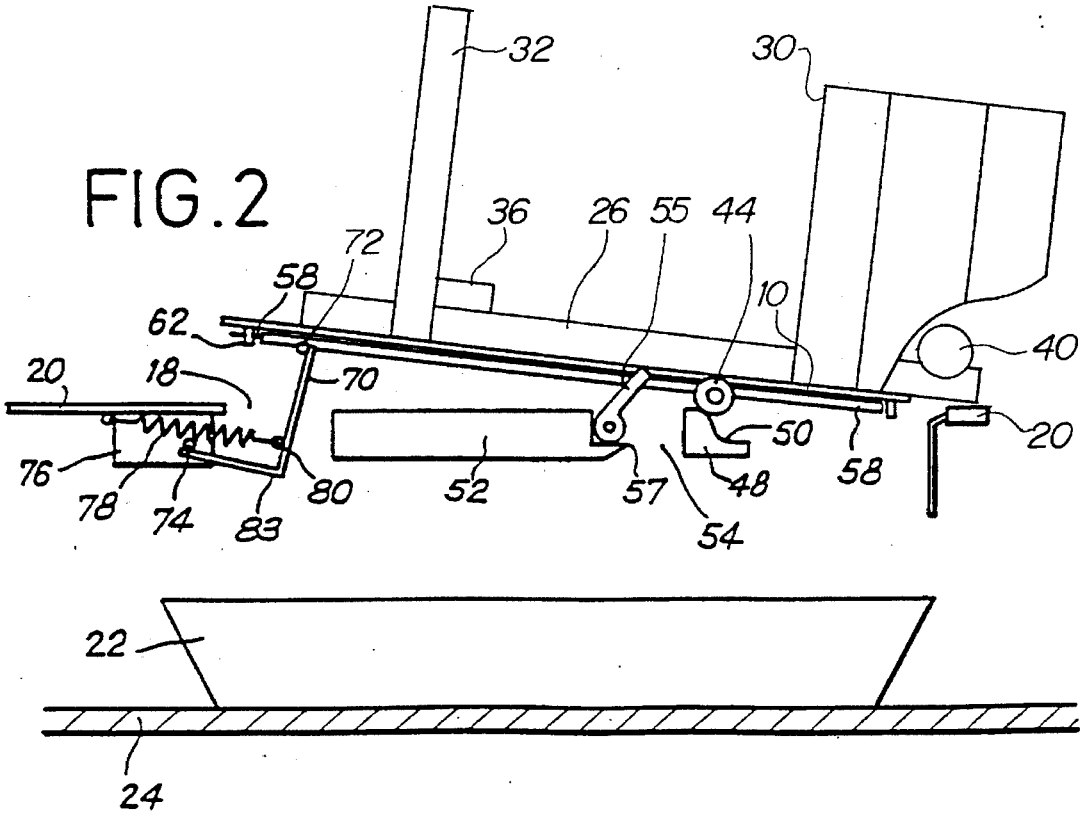
FIG. 2 is a simplified elevation of the stacker and of the box for final reception of articles.

Referring firstly to FIGS. 1 and 2, the principle of the stacker of the invention will be described. It is formed essentially by art elongated plate 10 which is sufficiently rigid to receive the set of articles to be stacked. The plate 10 has a tint free end 12 and a second end 14 provided with a handle 16 for manipulating the slacking plate 10 in order to effect the taking off of the articles. As explained later, the plate 10 is pivoted, In its horizontal position, the plate closes an opening 18 formed in the upper working surface 20 of the sorting machine. Below the opening 18 there is located a box 22 for receiving in the suitable order the various articles after their definitive sort. This box 22 rests on a structural part 24 of the frame of the sorting machine.

The stacker further comprises retaining means given the general reference 26. These retaining means for articles comprise support means 28 located parallel to the major length of the plate 10 on one side thereof. On the support member 28 there is fixed a first retaining plate or vane 30, which is fixed to the end of the support assembly 28 near to the end 12 of the plate 10. The retaining means 26 comprise a second retaining plate 32 whose general direction is parallel to that of the retaining plate 30. The plate 32 is guided for translation parallel to the major length of the plate 10 by a bush 36 slidably mounted on a rod 38 integral with the support assembly 28. A restoring system formed for example by a spring 40 fixed to the support assembly urges the second retaining plate 32 toward the first plate 30. Finally the support assembly 28 comprises a vertical plate part which will be described later and is referenced 42 and is parallel to the stacking plate 10.

It will be understood now that the various articles rest edgewise, vertical on the plate 10, that they are held against each other between the retaining plates 30 and 32 under the action of the restoring system 40, and that one of the sides of each article is butted against the positioning plate 42.

As will be explained later, the retaining assembly 26 is preferably not fixed relative to the machine frame 20 but can be translated horizontally lengthwise of the plate 10, in such a manner that the articles disposed in the stacker can be brought all together closer to the operator while the stacking plate 10 remains stationary.

Figure 3:
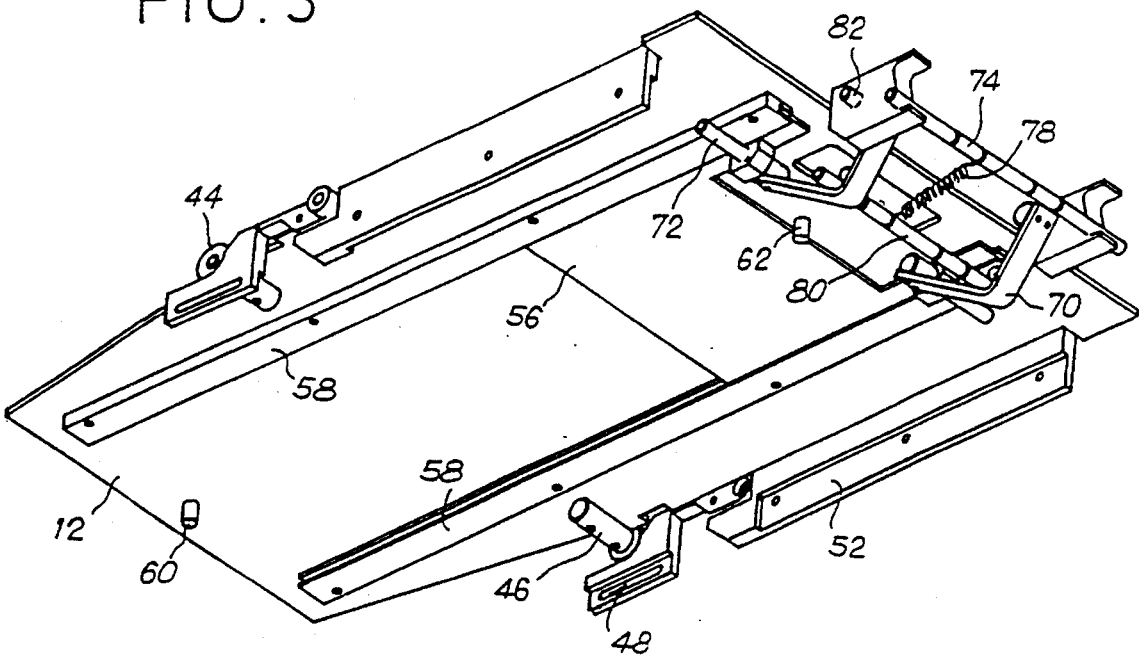
FIG. 3 is a perspective view from below of the stacker.

In order to allow transfer without changing the order of the articles from the stacking plate 10 to the box 22, the plate 10 can be shifted from its horizontal position into a pivoted position. To allow this pivotal movement, the plate 10 is fitted on each of its sides with a roller 44, 46. Each roller cooperates with a lateral guide member fixed to the frame of the machine. The guide member comprises a first part 48 forming a rising ramp 50 and a second horizontal part 52, these two guide parts being separated by a gap 54 which can be closed by a pawl 55 associated with a restoring spring 57. Moreover, in order to guide the pivotal movement of the plate 10 relative to the frame of the machine, a control mechanism for the displacement of the plate is provided at the end 14 of the plate 10. This mechanism, as is best shown in FIG. 3, is formed in the first place by a sliding plate 56 engaged in slides 58 and 60 fixed to the lower face of the plate 10. The movement of the plate 56 is limited by stops referenced 60 and 62 respectively fixed to the lower face of the plate 10. A cranked arm 70 has a first end which is pivoted to the plate 56 about an axis 72 while its other end is pivoted about a spindle 74 mounted to pivot in a part 76 fixed to the frame 20 of the machine. An elastic restoring system 78 is connected on the one hand to the fixed part 76 and on the other hand to the point 80 of the arms located between the pivotal axis 72 and the apex of the crank 82 formed by each arm.

The manipulation of the stacking plate 10 to effect the transfer of articles placed thereon to the box 22 is effected in the following manner. The operator grasps the plate 10 by the handle 16 and raises it, which keeps the sliding plate 56 against the abutment 62 under the action of the restoring spring 78 of the arm 70. The plate 10 thus retracts slightly. In this retracting movement, the rollers 44, and 46 fixed to the plate 10 roll on the guide members 48, resulting at the same time in lifting of the plate 10 under the action of the ramp 50. This lifting of the plate 10 allows raising of the pawl 55 under the action of the spring 57, which frees the gap 54 in between the lateral guide members 48, 52. The cranked arm 70, always subject to the action of the restoring spring 78, completes its movement about the axis 74 on bearing against an abutment 82, thus pulling the plate 10, whose rollers 44 and 46 pass through the gaps 54 in the lateral guide members, which causes tilting of the plate 10 and of the articles stacked thereon, through rotary movement about the axis 74. The end 12 of the plate 10 bean against the bottom of the box 22. The end 12 of the plate 10 is shaped to fit the profile of the box 22 precisely. The stack of articles thus slides partially off the plate 10 so as to arrive in the box 22. During this transfer, the articles remain in the same order as that in which they were stacked on the plate 10. To complete the emptying operation, the operator continues to raise the plate 10 by means of the handle 16. The plate 10 slides on the sliding plate 56 while executing a rotary movement about the axis 72. The end 12 of the plate 10 stays in contact with the bottom of the box 22 as it moves. In this movement the rest of the articles slide off the plate 10 so as to get into the box 22. When the plate 10 is vertical, the whole stack of articles, typically letters, is located on edge in the box 22 in an identical order to that which they had in the stacker.

The rest of the movement of the plate 10 consists in returning it into its initial horizontal position. For this, the operator continues to raise the plate 10, until the stop 60 comes into contact with the sliding plate 56. The rollers 44 and 46 of the plate 10 move above the lateral guide members 48 and 52. The operator inclines the plate 10 towards himself by rotation about the axis 72, then pushes the plate 10 back, the rollers 44 and 46 coming into contact with the lateral guide members 48 and 52. In this return movement, the rollers 44, 46 press down the pawls 55, closing the gaps 54 in the guide members. The stop 62 of the plate 10 comes into contact with the plate 55, which has the effect of pushing back the cranked arm 70, the operator providing a greater effort than the return spring 78, until restoration of the plate 10 to the horizontal position closing the opening 18 in the upper plate 20 of the frame of the machine. The stacker is again in position to receive new articles.

FIGS. 8*a* to 8*d* show the various phases and the various position of the plate 10 during the operation of transferring the articles from the plate 10 to the box 22.

Figure 4:
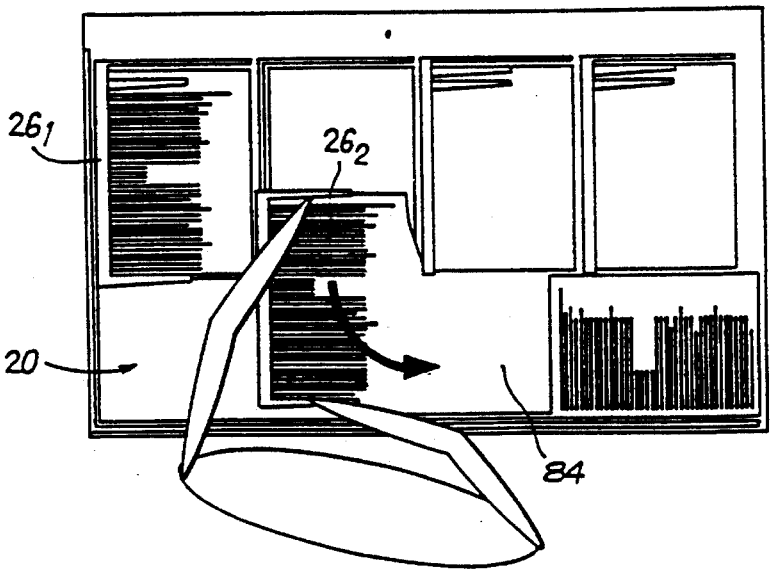
FIG. 4 is a simplified top view of the assembly of the upper surface of the sorting machine, showing the arrangement of the various stackers.

In the preceding description it has been assumed that the support and retaining means 26 remain fixed relative to the upper surface 20 of the sorting machine. In a preferred embodiment, the support and retaining means can be translated horizontally between a rest position and a closer position. In FIG. 4 the retaining means $\mathbf{26}_1$ are shown in the rest position and the retaining means $\mathbf{26}_2$ in the closer position. It will be understood that, in this second position, the stack of articles is brought closer to the operator, which obviously facilitates manual transfer of the articles from the retaining means to the transfer region 84 of the sorting machine. As explained later, in this displacement, the stacking plate 10 stays in the same place, only the support means and thus the retaining members 30 and 32 being shifted. In the closer position of the support means 26, some articles stay on the plate 10 while the others are engaged with the transfer region 84.

Figure 5:
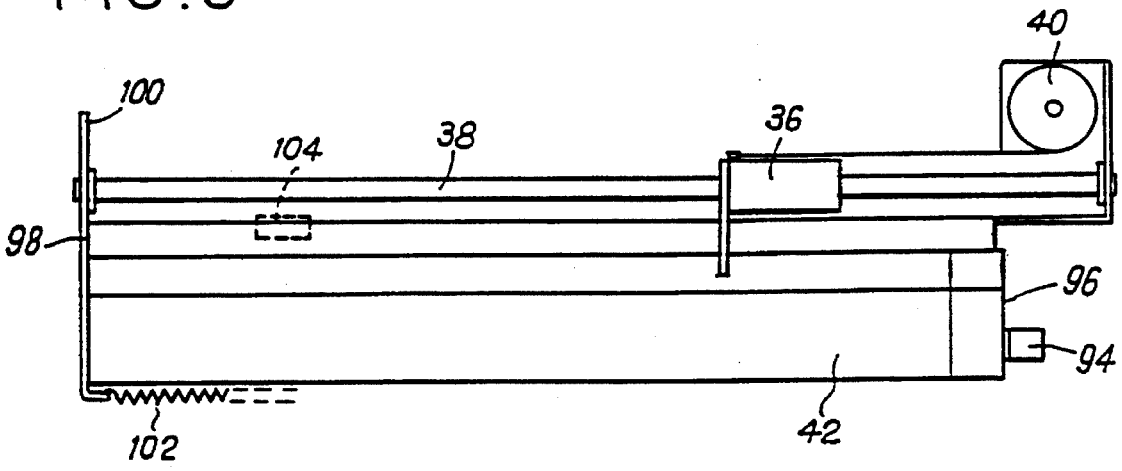
FIG. 5 is a side view of the stacker with associated means for assisting transfer.
Figure 6:
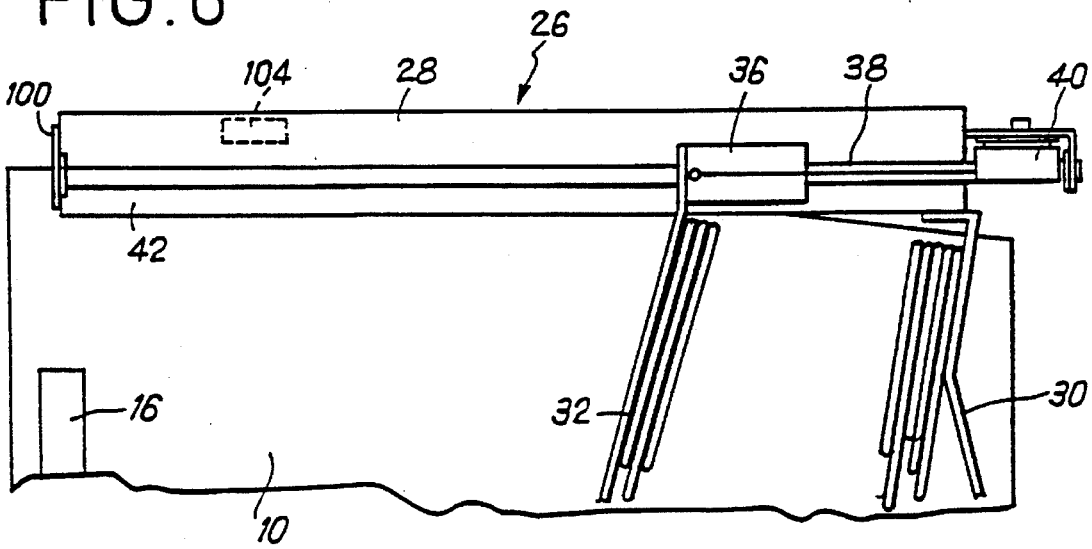
FIG. 6 is a partial top view of the stacker of FIG. 5.
Figure 7:
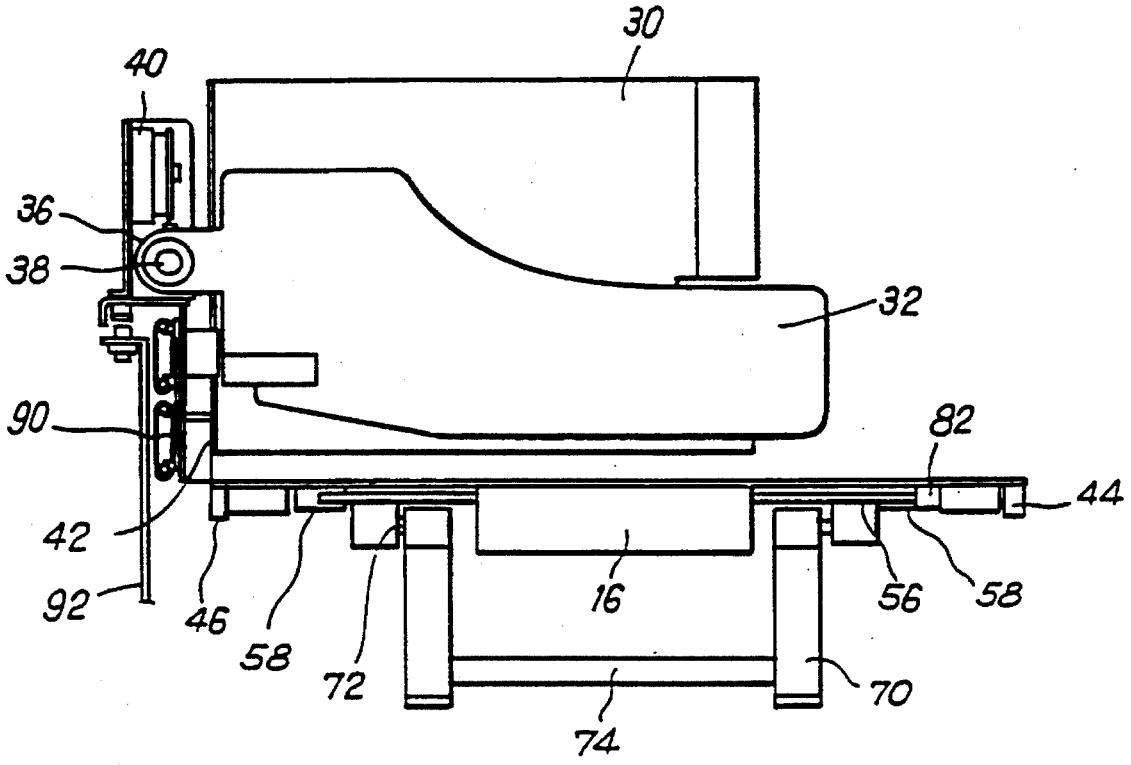
FIG. 7 is a side view of the stacker of FIG. 5.
Figure 8A:
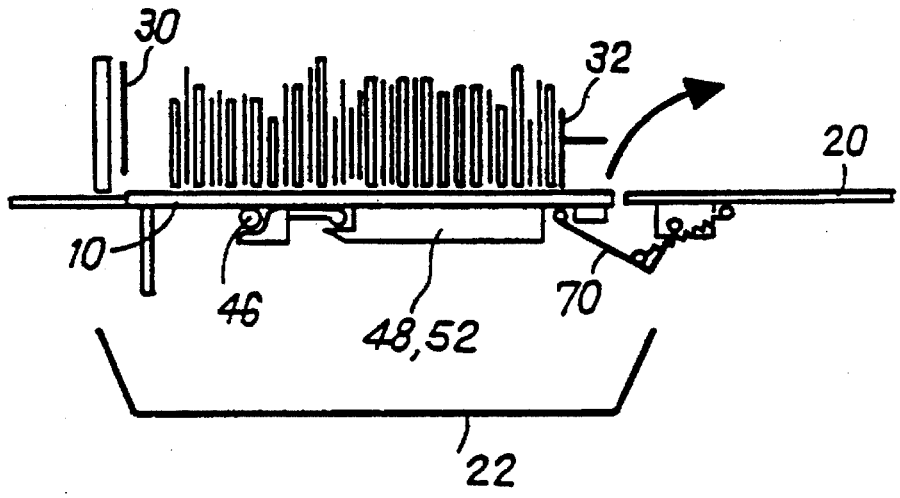
FIGS. 8*a* to 8*d* an simplified views showing the operation of emptying articles from the stacker into the box receiving the articles.
Figure 8B:
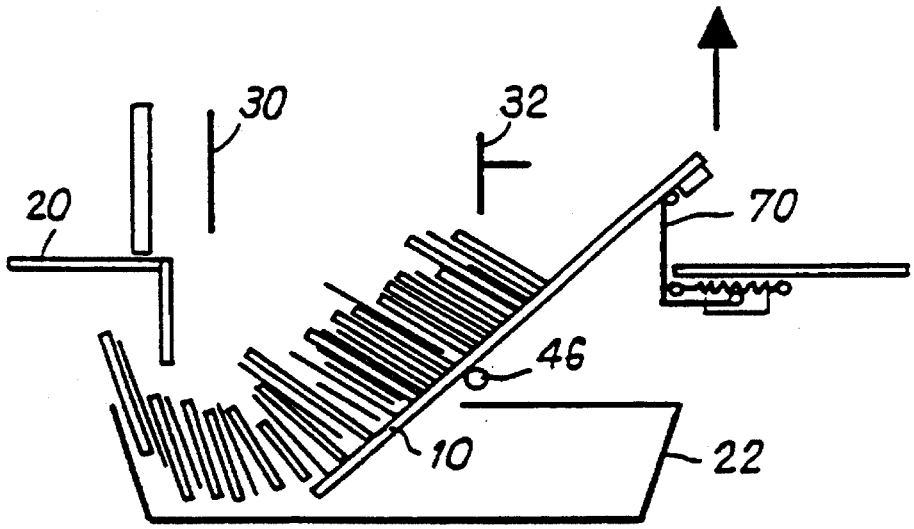
Figure 8C:
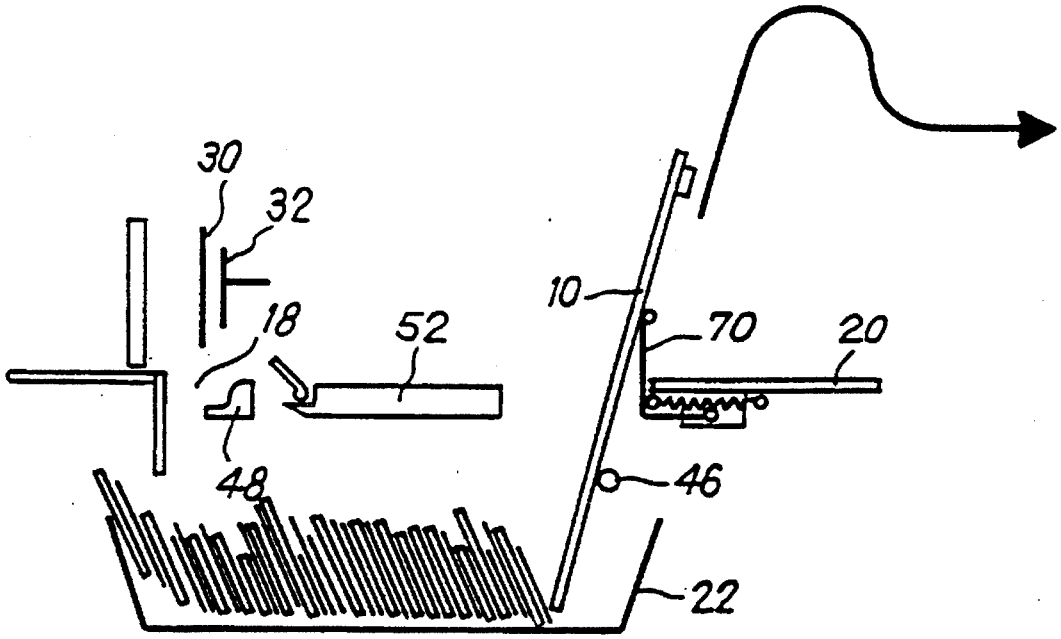
Figure 8D:
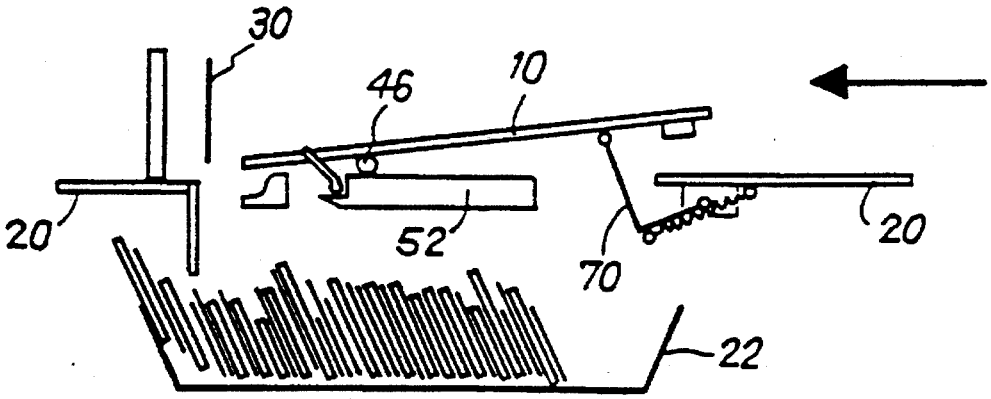

Referring now more particularly to FIGS. 5 to 7, a preferred embodiment of the support means 26 allowing displacement thereof will now be described. FIG. 7 shows that the vertical plate 42 forming the base of the support means 26 is mounted to slide in the direction of the length of the plate 10 by means of ball slides 90 fixed for the one part on the plate 42 and for the other part on a plate 92 integral with the frame of the sorting machine. The assembly 26 is held in its rest position by a fixed magnet 94 which cooperates with one end 96 of the vertical plate 42. The other end 98 of the plate 42 is fired with a handle 100. Furthermore a return spring 102 tends to return the plate 42 to its rest position when it has been brought into its closer position. Ball detents 104 for example allow the plate 42 to be held temporarily in the closer position, during the extraction of the articles.

To effect a transfer operation, the operator draws the plate 42 towards himself by means of the handle 100. In this displacement the set of articles inserted between the two retaining plates 30 and 32 is brought closer to the operator, the edges of the articles sliding on the stacking plate 10 and then partially on to the transfer region 84. In this position, the operator can easily grasp the stack of articles with his two hands and extract it from the stacker.

Under the action of the restoring system 40, the retaining plate 32 comes into contact with the fixed retaining plate 30, striking against the same. Under action of the shock, the ball detent 104 is released and the plate 42 returns to its rest position under the action of the return spring 102.

We claim:

1. An article handling system comprising:

a frame defining an upper, horizontal working surface;

means for supporting a receptacle for final reception of articles, disposed below an opening formed in said upper surface;

an elongated plate mounted for pivotal movement about a pivot device, said pivot device including a cranked arm system pivotable at one end about an axis fixed relative to the frame and pivotable at another end about an axis fixed relative to a sliding plate slidably mounted to a lower face of said elongated plate to slide in a lengthwise direction of said elongated plate, said elongated plate having a first, horizontal position in which it closes said opening and being adapted to be put in a pivoted position in which one of its ends reaches into said receptacle; and means for retaining said articles, comprising an elongated support disposed parallel to the lengthwise direction of said plate in its horizontal position and fixed to remain immovable relative to said upper working surface at least in a vertical direction, a first retaining member, fixed to a first end of said elongated support, for retaining said articles, a second retaining member, mounted for movement relative to said elongated support and guided thereby, for retaining said articles, restoring means for urging said second retaining member toward said first retaining member, and means, fixed to said elongated support and disposed parallel to said elongated plate, for positioning said articles, whereby, when said elongated plate is in its horizontal position, said articles can be stacked between said first and second retaining members, resting on said elongated plate and being butted up against said positioning means and, when said elongated plate is in its pivoted position, said articles can be placed in said receptacle.

2. An article handling system according to claim 1, wherein said means for retaining articles are horizontally movable in translation relative to said frame in the lengthwise direction of the plate.

3. An article handling system according to claim 1, wherein the pivot device further comprises two rollers disposed on opposite sides of said elongated plate, and lateral guide means for cooperating with said rollers to facilitate pivoting of said elongated plate.

4. An article handling system according to claim 3, further comprising resilient restoring means, whose one end is fixed to said cranked arm and whose other end is fixed to the frame.

5. An article handling system according to claim 2, wherein the elongated support comprises a substantially vertical plate forming said positioning means, said substantially vertical plate being mounted for movement in translation relative to said frame by way of slider systems.

6. An article handling system according to claim 5, wherein said first retaining member is fixed to a first end of the vertical plate and in that the second end thereof is fitted with a manual manipulating member.

7. An article handling system according to claim 5, wherein said second retaining member is guided in translation by a rod fixed to said plate and parallel to the lengthwise direction thereof.

* * * * *